US005125348A

United States Patent [19]

Horwitz

[11] Patent Number: 5,125,348

[45] Date of Patent: Jun. 30, 1992

[54] TABLE CONSTRUCTION

[75] Inventor: Norton J. Horwitz, Knoxville, Tenn.

[73] Assignee: Robert E. Ivins, Knoxville, Tenn. ; a part interest

[21] Appl. No.: 685,474

[22] Filed: Apr. 12, 1991

[51] Int. Cl.[5] ..... A47B 3/06

[52] U.S. Cl. ..... 108/153; 108/111

[58] Field of Search ..... 108/153, 154, 156, 157, 108/111, 91, 27, 53.1; 211/188, 194

[56] References Cited

U.S. PATENT DOCUMENTS

| | | | |
|---|---|---|---|
| 1,575,410 | 3/1926 | Bradley . | |
| 1,734,340 | 11/1929 | Overton . | |
| 2,681,261 | 6/1954 | Bunk | 108/27 |
| 3,347,186 | 10/1967 | Khattar | 108/91 |
| 3,521,349 | 7/1970 | Gehring . | |
| 3,858,529 | 1/1975 | Salladay | 108/111 X |
| 4,083,641 | 4/1979 | Sado . | |
| 4,223,613 | 9/1980 | Yoshizawa | 108/91 X |
| 4,474,416 | 10/1984 | Rogahn | 108/153 X |
| 4,501,512 | 2/1985 | Hiltz | 108/153 X |
| 4,836,393 | 6/1989 | Maye | 108/91 X |
| 4,902,080 | 2/1990 | Berger . | |

FOREIGN PATENT DOCUMENTS

| | | |
|---|---|---|
| 526928 | 3/1954 | Belgium . |
| 1091394 | 10/1960 | Fed. Rep. of Germany . |

*Primary Examiner*—José V. Chen

*Attorney, Agent, or Firm*—Luedeka, Hodges, Neely & Graham

[57] ABSTRACT

A multi-level table including an upper section and a lower section providing superposed tabletop surfaces and a plurality of upstanding support posts connected between the upper and lower sections utilizes mounting members interposed between the ends of the support posts and the upper and lower sections to which the support posts ends are connected. Each mounting member includes a cup-shaped section for accepting a corresponding end of a support post and at least one protuberance extending from the cup-shaped section. The upper and lower sections each include appropriately-sized recesses for accepting the cup-shaped section of a mounting member and a through-opening associated with the recess so that when the cup-shaped section is accepted by the recess, the protuberance of the mounting member is accepted by the through-opening. The protuberance of each mounting member has a fastener-accepting aperture, and a fastener is tightened within the fastener-accepting aperture of each protuberance so that the upper and lower sections are tightly held between the mounting members and the heads of the fasteners secured at the support post ends.

15 Claims, 4 Drawing Sheets

TABLE CONSTRUCTION

BACKGROUND OF THE INVENTION

This invention relates generally to the construction of tables and relates, more particularly, to means and methods for securing a tabletop section of a table to the legs of the table.

The type of table with which this invention is to be compared includes a tabletop section providing an upwardly-facing surface and a plurality of upstanding legs or support posts joined to the tabletop section.

It is an object of the present invention to provide a new and improved table of the aforedescribed class.

A further object of the present invention is to provide such a table incorporating improved means for securing the tabletop section of the table to the legs or support posts of the table.

Another object of the present invention is to provide such a table which is relatively uncomplicated in construction and may be assembled relatively quickly.

Still another object of the present invention is to provide such a table which is relatively stable when assembled and attractive in appearance.

Yet another object of the present invention is to provide a table construction whose construction principles are well-suited for incorporation within a multi-level table.

SUMMARY OF THE INVENTION

This invention resides in a table including a tabletop section providing an upwardly-facing surface and an opposite downwardly-facing surface, at least one elongated support post connected to the tabletop section, and a mounting member interposed between one end of the support post and the tabletop section. The mounting member includes a cup-shaped section opening in one direction for accepting the on end of the support post inserted endwise therein and at least one protuberance joined to the cup-shaped section and directed generally in a second direction opposite the one direction. The protuberance includes a fastener-accepting aperture which opens in the second direction. The tabletop section includes a recess in one of its upwardly or downwardly-facing surfaces for receiving the cup-shaped section of the mounting member and a through-opening communicating with the recess for receiving the protuberance of the mounting member when the cup-shaped section is received by the recess. The table further includes a headed fastener having an elongated shank and a head at one end of the shank, and the shank is secured within the fastener-receiving opening of the protuberance so that the tabletop section is tightly secured between the cup-shaped section of the mounting member and the head of the fastener.

DETAILED DESCRIPTION OF AN ILLUSTRATED EMBODIMENT

Figure 1:
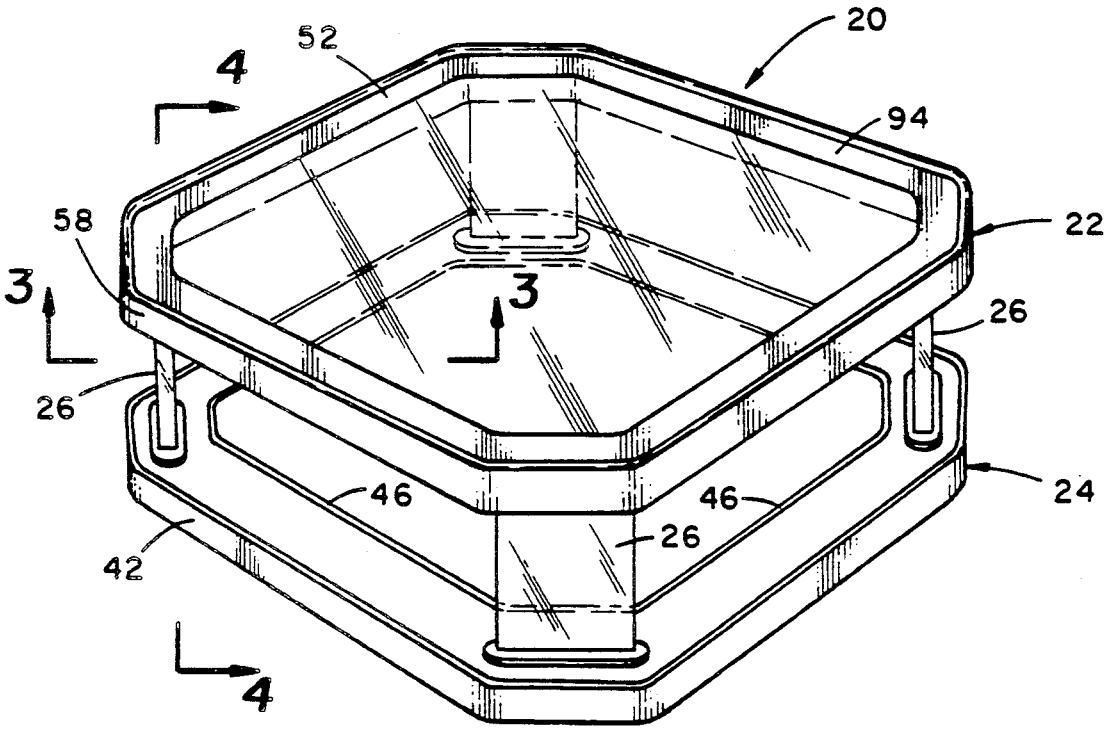
FIG. 1 is a perspective view of a coffee table within which features of the present invention are incorporated.

Turning now to the drawings in greater detail, there is illustrated in FIG. 1 a coffee table 20 which embodies various features of the present invention. The table 20 includes upper and lower sections 22, 24, respectively, and a plurality of support posts 26 extending between the upper and lower sections 22, 24. The lower section 24 is supported upon the underlying floor (indicated 28 in FIGS. 3 and 4), the support posts 26 extend upwardly from the lower section 24 and the upper section 22 is supported atop the posts 26. As is described in greater detail herein, the support posts 26 are connected to each of the upper and lower sections 22, 24 in a manner which stably joins the upper and lower sections 22, 24.

Although the table 20 described herein is a multi-leveled table providing two horizontally-disposed tabletop surfaces in a superposed relationship, it will be understood that a table incorporating features of the present invention may include a single tabletop surface supported atop a plurality of support posts or legs. Accordingly, the principles of the present invention may be variously applied.

Figure 2:
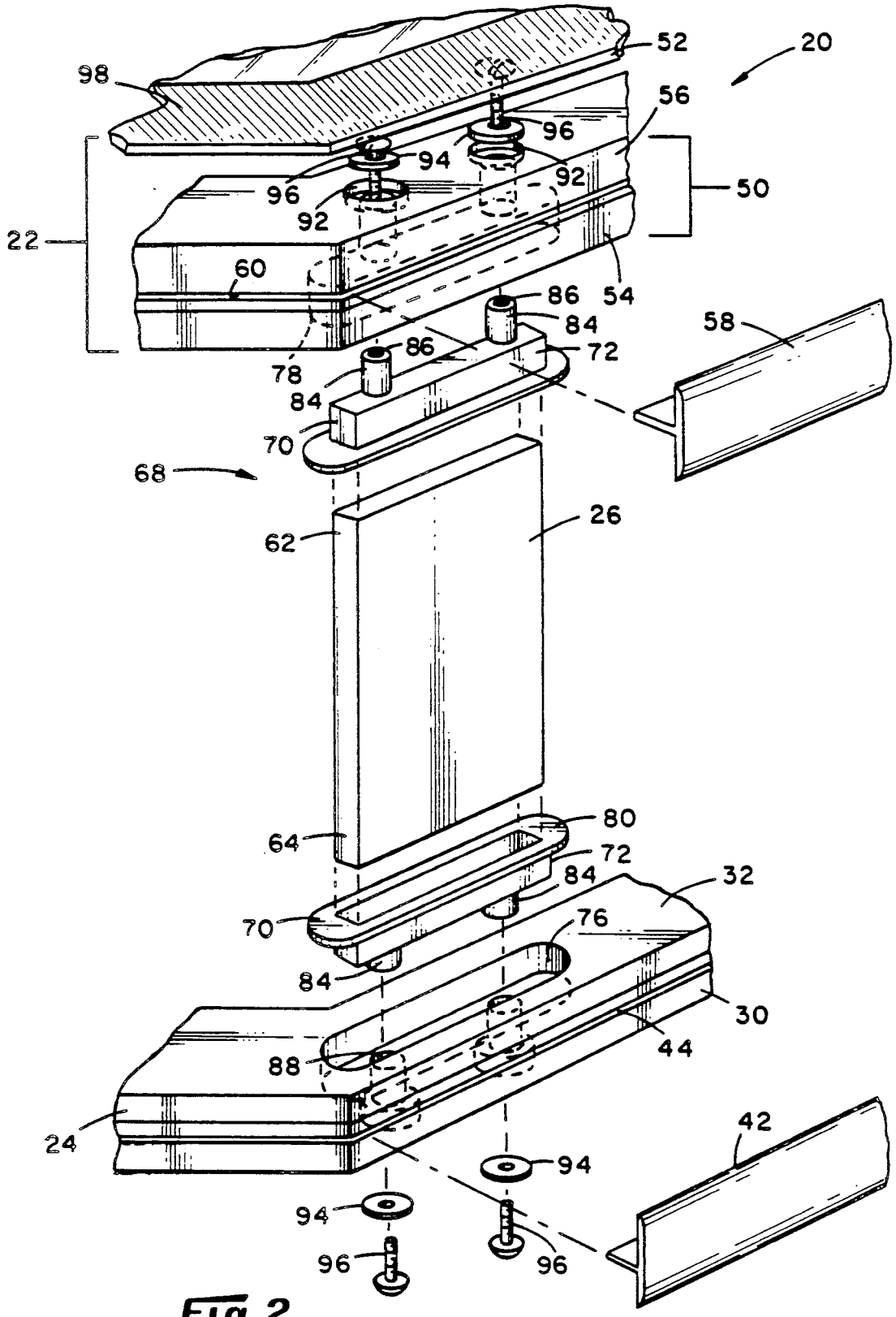
FIG. 2 is a perspective view of a fragment of the FIG. 1 table, shown exploded.
Figure 3:
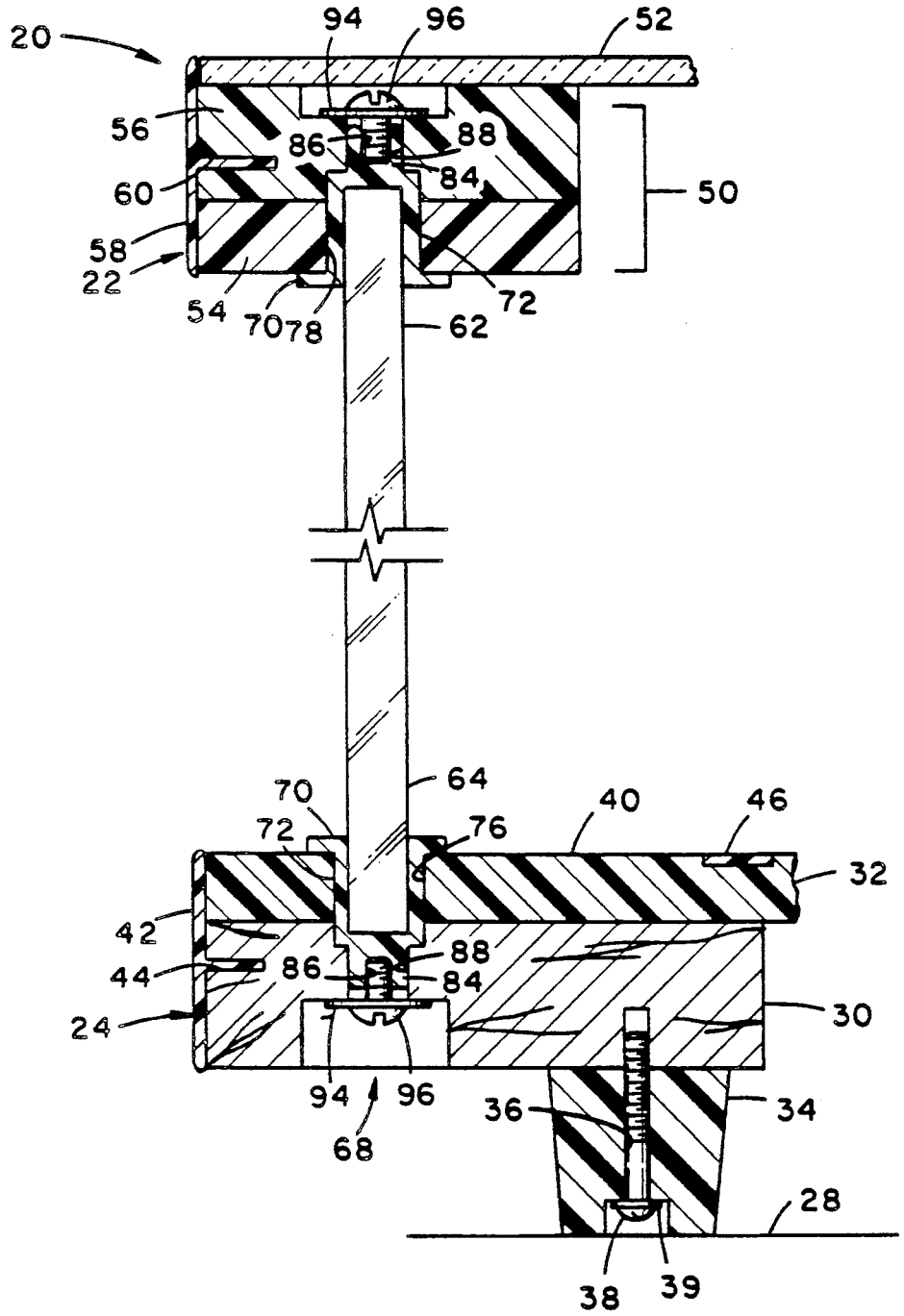
FIG. 3 is a cross-sectional view taken along line 3—3 of FIG. 1.
Figure 4:
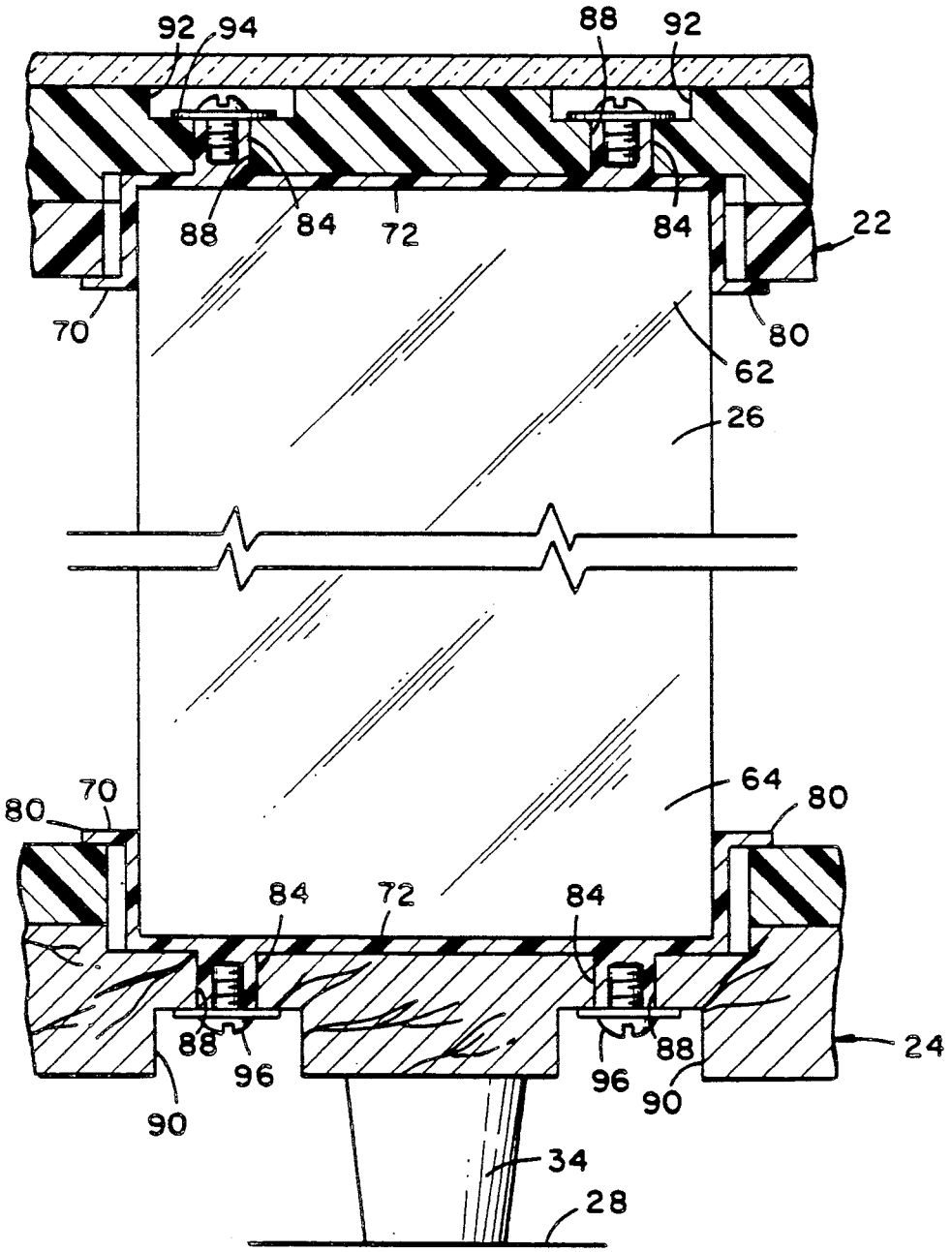
FIG. 4 is a cross-sectional view taken along line 4—4 of FIG. 1.

With reference to FIGS. 2–4, the lower section 24 of the table 20 includes a support frame 30 overlain by a top layer 32. A plurality of feet 34 (only one shown in FIGS. 3 and 4) are fastened to the underside of the support frame 3 for supporting the frame 30 and top layer 32 in a substantially horizontal orientation. Each foot 34 has a central through-aperture 36 for receiving the shank of a screw 38 directed through the aperture 36 and into the underside of the support frame 30 so that each foot 34 is tightly held between the underside of the support frame 30 and the head of the screw 38. Preferably, the head of the screw 38 is countersunk within the bottom of the foot 34, and, if desired, a washer 39 may be positioned between the head of the screw 34 and foot 34 as shown in FIG. 3. Each foot 34 may be constructed out of any of a number of suitable materials, such as a hard plastic.

Each of the support frame 30 and top layer 32 are constructed of particle board which have been laminated together to form a unitary structure. In the depicted table 20, the upper surface, indicated 40, of the top layer 32 has been coated with a high-gloss layer of paint which is preferably applied with an electron-beam process to provide the upper surface 40 with a very smooth, highly-reflective finish. If desired, the upper surface 40 may be decorated with a strip of molding 46 inlaid into the upper surface 40 as shown in FIG. 1. The outer edges of the frame 30 and top layer 32 are substantially even with one another as shown in FIG. 4, and a decorative edge molding 42 is attached around the outer edges of the frame 30 and top layer 32. The molding 42 is T-shaped in cross-section, and the outer edge of the frame 30 includes an outwardly-directed groove 44 for tightly accepting the base leg of the molding 42. With the base leg of the molding 42 received by the groove 44, the arms of the molding 42 span the thickness of the frame 30 and top layer 32. The attachment of the molding 42 to the outer edges of the frame 30 and top layer 32 is enhanced by the introduction of a suitable adhesive therebetween. In the depicted table 20, the molding 42 has a body constructed of plastic which has been metallized, such as with a brass finish, to provide the molding 42 extending around the lower section 24 with a smooth, highly-reflective finish.

With reference still to FIGS. 3 and 4, the upper section 22 of the table 20 includes a support frame 50 and a top layer 52 overlying the support frame 50. The support frame 50 is constructed of two plys 54, 56 of particle board which have been laminated together to provide the frame 50 with a substantial thickness. The top layer 52 of the upper section 22 is constructed of glass having outer edge dimensions which correspond generally to those of the frame 50. The support frame 50 is bordered by a decorative edge molding 58 of T-shaped cross-section which has been attached to the frame 50 by means of an outwardly-directed groove 60 formed within the edge of the upper ply 56 as illustrated in FIG. 3. More specifically, a base leg of the edge molding 58 is securely accepted by the groove 60 so that the arms of the molding 58 overlie the outer edges of the frame 50. The molding 58 is sized so that when the top layer 52 is placed in overlying relationship with the frame 50, the arms of the molding 58 span the thickness of the frame 50 and the top layer 52 Like the molding 42 of the lower section 24, the molding 58 of the upper section 22 has a body constructed of plastic which has been metallized to provide the molding 58 with a smooth, highly-reflective finish.

Each support post 26 of the table 20 is in the shape of a rectangular prism and has two opposite ends 62, 64 for cooperatively interfitting with the upper and lower sections 22, 24 of the table 20. Each end 62 or 64 of each support post 26 terminates in an elongated, rectangular face which lies in a substantially horizontal plane. In the table 20, there are four support posts 26, and each post 26 is constructed of a transparent glass.

The table 20 also includes means, generally indicated 68, associated with each end 62 or 64 of a post 26 for securing the post end to a corresponding one of the upper and lower sections 22, 24 of the table 20. In the depicted table 20, the securing means 68 includes a preformed mounting member 70 which is shaped to receive a corresponding end 62 or 64 of a post 26 and is shaped for acceptance by an appropriately-formed recess described herein provided within the upper and lower table sections 22, 24. In this connection, each mounting member 70 includes a cup-shaped section 72 of substantially rectangular cross section sized to snugly receive a corresponding end 62 or 64 of a support post 26 and so that when the corresponding support post end 62 or 64 is fully inserted into the cup-shaped section 72, the planar face of the post end 62 or 64 flatly engages the base of the cup-shaped section 72. The post end 62 or 64 is secured within the cup-shaped section 72 of its corresponding mounting member 70 with a suitable adhesive, such as an epoxy.

For receipt of the mounting member 70 by the lower section 22 and as best shown in FIG. 2, an appropriately-sized, upwardly-opening recess 76 is formed within the top surface 40 of the lower section 24 within which the cup-shaped section 7 is received. Similarly, for acceptance of the cup-section 72 of the mounting member 70 by the upper section 22, the support frame 50 of the upper section 22 includes an appropriately-sized, downwardly-opening recess 78 formed in its downwardly-facing surface for receiving the cup-shaped section 72. Each of the recesses 76, 78 are formed by a routing process. The cup-shaped section 72 of each mounting member 70 further includes an outwardly-directed flange 80 and its depth corresponds generally to the depth of the recess 76 or 78 provided in the upper and lower sections 22, 24 so that when the mounting member 70 is received by its corresponding recess 76 or 78, the flange 80 lies against the surface within which the recess 76 or 78 is defined.

The mounting member 70 also includes a pair of protuberances or dowel portions 84 joined to the cup-shaped section 72 so as to protrude in the direction opposite the direction in which the cup-shaped section 72 opens. The dowel portions 84 are arranged generally parallel to one another and ar positioned adjacent opposite ends of the cup-shaped section 72 a best shown in FIGS. 2 and 3. Each dowel portion 84 of the depicted mounting member 70 also includes a fastener-accepting aperture 86 extending axially of each portion 84 and which is internally threaded. Preferably, the mounting member 70 is formed out of plastic in an injection molding process and is metallized with a brass or other suitable metal to enhance the appearance of the mounting member 70 when positioned in its corresponding recess 76 or 78.

With reference still to FIGS. 2 and 3, there are also provided within the upper and lower sections 22, 24 a pair of circular through-openings 88 which extend through the upper and lower sections 22. 24 so as to open into the base of the recess 76 or 78. When the mounting member 70 is positioned within its corresponding recess 76 or 78, each through-opening 88 receives a corresponding one of the dowel portions 84 as shown in FIG. 4. Accordingly, the diameter of each through-opening 88 is slightly greater than the diameter of each dowel portion 84. It is a feature of the table 20 that the surfaces of the upper and lower sections 22, 24 opposite the surfaces within which the recess 76 or 78 is formed is provided with a circular recess 90 or 92 which communicates with the recess 76 or 78 by way of the through-opening 88.

To secure the support posts 26 to the upper and lower sections 22, 24 with the mounting member 70, the end of each post 26 is inserted and adhesively secured within the cup-shaped sections 72 of the mounting member 70, and the cup-shaped section 72 of each member 70 is then positioned within the recess 76 or 78 of the upper and lower sections 22, 24 so that the dowel sections 84 protrude into the through-openings 88 of the corresponding upper and lower sections 22, 24. At that point, a flat washer 94 is positioned so that its central opening is aligned with the internally-threaded opening 86 of each dowel section 84, and a screw 96 is screwed into each dowel section opening 86 so that the upper section frame 50 o lower section 24 is tightly held between the head of the screw 96 and the cup-shaped section 72 of the corresponding mounting member 70. Each support post 26 is thereby secured at each of its ends to the corresponding one of the upper and lower sections 22 or 24.

As best shown in FIG. 3, the length of each dowel section 84 is no longer than the depth of the through-opening 88 into which the dowel section 84 protrudes to enable the screws 96 to be rotated to a tightened condition within the dowel section 84. Furthermore, the depth of each circular recess 90 or 92 provided in the corresponding surfaces of the upper and lower sections 22 or 24 is at least as great as the cumulative height of the head of the screw 96 and the thickness of the washer 94 so that when the screw 96 is fully tightened within the dowel section 84, the head of the screw 96 is countersunk, or fully positioned, within its corresponding recess 90 or 92.

It is a feature of the depicted table 20 that the table top layer 52 has been provided with an opaque section 98 (FIG. 1) adjacent its outer edge so that when the glass tabletop layer 57 is positioned upon the frame 50 of the upper section 22, the heads of the screws 96 extending through the frame 50 and the screw-receiving recesses 92 provided within the frame 50 are hidden from view by the opaque section 98. In the depicted table 20, the opaque section 98 has been formed by the application of a silvering compound upon the upper surface of the top layer 52 to provide the top layer 52 with a mirror-like finish for a predetermined width therearound.

It will be understood that numerous modifications and substitutions may be had to the aforedescribed embodiment without departing from the spirit of the invention. For example, although the support posts 26 of the table 2 have been shown and described as being constructed of a transparent glass, the support posts of a table in accordance with the broader aspects of the present invention may be comprised of an alternative material which provides the support posts with suitable hardness and rigidity. Accordingly, the aforedescribed embodiment is intended for the purpose of illustration and not as limitation.

I claim:

1. A table comprising:

a tabletop section having an upwardly-facing surface and a downwardly-facing surface;

at least one elongated support post connected to the tabletop section;

a mounting member interposed between one end of the support post and the tabletop section, the mounting member including a cup-shaped section opening in one direction for accepting the one end of the support post inserted endwise therein and at least one protuberance joined to the cup-shaped section and direction generally in a second direction opposite said one direction, the protuberance including a fastener-accepting aperture opening in said second direction; and the table top section including a recess in one of its downwardly-facing surface or upwardly-facing surface for receiving the cup-shaped section of the mounting member inserted protuberance-first into the recess and a through-opening communicating with the recess for receiving the protuberance of the mounting member when the cup-shaped section thereof is received by the recess; and a headed fastener having an elongated shank and a head at one end of the shank, said shank being directed through the through-opening and secured within the fastener-accepting aperture of the protuberance so that the tabletop section is tightly held between the cup-shaped section and the head of the fastener.

2. The table as defined in claim 1 wherein the tabletop section includes a support frame and a tabletop layer overlying the support frame, the support frame provides the downwardly-facing surface of the table top section and the recess opens out of the downwardly-facing surface, the support frame has a top surface opposite the downwardly-facing surface and underlying the tabletop layer, the top layer including a head-accepting recess within which the head of the headed fastener is countersunk, and the tabletop overlies the top surface of the support frame for hiding the head of the headed fastener from view.

3. The table as defined in claim 1 wherein the cup-shaped section of the mounting member is shaped to snugly accept the end of the support post when the support post is inserted endwise therein and includes an outwardly-directed flange for lying against the surface of the tabletop section when the cup-shaped section is received by the recess in the tabletop section.

4. The table as defined in claim 1 wherein the support post has a cross sect which is relatively elongated in shape and the mounting member includes two protuberances joined to the cup-shaped section wherein each protuberance includes a fastener-accepting aperture opening in said second director and the tabletop section includes two through-openings for receiving the protuberances of the mounting member when the cup-shaped section is received by the recess, and the table includes a pair of headed fasteners wherein the shank of each fastener is secured within a corresponding one of the protuberances so that the tabletop section is held between the cup-shaped section and the heads of the fasteners.

5. The table as defined in claim 1 wherein the length of the protuberance as measured from the cup-shaped section is no greater than the depth of the through-opening provided within the tabletop section for receiving the protuberance.

6. The table as defined in claim 1 wherein the recess of the tabletop section is provided in the upwardly-facing surface so that the shank of the headed fastener extends upwardly into the fastener-accepting aperture of the protuberance from the downwardly-facing surface and the downwardly-facing surface includes a head-receiving recess within which the head of the fastener is countersunk.

7. The table as defined in claim 1 wherein the table is a multi-level table having at least two tabletop sections wherein one of the tabletop sections is superposed above the other tabletop section and the support post is disposed between the tabletop sections for maintaining the tabletop sections in a spaced relationship.

8. A table comprising:

an upper section including an upper support frame having an upwardly-facing surface and an opposite downwardly-facing surface;

a lower section having a upwardly-facing surface and an opposite downwardly-facing surface;

a plurality of elongated support posts disposed between the upper and lower sections for maintaining the upper and lower sections in a spaced relationship;

a plurality of mounting members each having a cup-shaped section for accepting an end of a support post so that each end of each support post is accepted by the cup-shaped section of a mounting member, each mounting member including at least one protuberance joined to the cup-shaped section and directed generally in a direction opposite the direction in which the corresponding cup-shaped section opens, each protuberance including a fastener-accepting aperture opening in the opposite direction;

the downwardly-facing surface of the upper support frame including a plurality of first recesses each adapted to accept the cup-shaped section of the mounting members positioned about one end of the support posts and a through-opening associated with each of the first recesses for accepting the protuberance of a corresponding mounting member when its cup-shaped section is received by the first recess;

the upwardly-facing surface of the lower section including a plurality of second recesses each adapted to accept the cup-shaped section of the mounting member positioned about the other ends of the support posts and a through-opening associated with each of the second recesses for accepting the protuberance of a corresponding mounting member when its cup-shaped section is received by the second recess; and at least one headed fastener for fastening the one end of each support post to the upper support frame and at least one headed fastener for fastening the other end of each support post to the lower section, each of the headed fasteners having an elongated shank and a head at one end of the shank, each shank being secured within the fastener-accepting aperture of the protuberance of a corresponding mounting member so that the upper support frame is tightly held between the cup-shaped section of the mounting member at one end of each support post and the head of the one fastener and the lower section is tightly held between the cup-shaped section of the mounting member at the other end of each support post and the head of the another fastener.

9. The table as defined in claim 8 wherein the shank of one fastener extends downwardly through the upper support frame and into the protuberance of a mounting member from the upwardly-facing surface of the upper support frame, and the upwardly-facing surface of the upper support frame includes a head-receiving recess within which the head of the one fastener is countersunk.

10. The table as defined in claim 9 wherein the upper section includes a tabletop layer overlying the upwardly-facing surface of the upper support surface and which hides the head of the one fastener from view.

11. The table as defined in claim 8 wherein the shank of the other fastener extends upwardly through the lower section and into the protuberance of a mounting member from the downwardly-facing surface of the lower section, and the downwardly-facing surface of the lower section includes a head-receiving recess within which the head of the another fastener is countersunk.

12. The table as defined in claim 8 wherein the opposite ends of the support posts are identical in cross-sectional shape and each mounting member is of identical construction so that any of the mounting members may be positioned about either end of any one of the support posts.

13. A table comprising:

a lower section having a downwardly-facing surface and an opposite upwardly-facing surface within which is defined an upwardly-opening recess, the lower section also including a through-opening communicating with the upwardly-opening recess from the downwardly-facing surface of the lower section;

an upper section having an upwardly-facing surface and an opposite downwardly-facing surface within which is defined a downwardly-opening recess, the upper section also including a through-opening communicating with the downwardly-opening recess from the upwardly-facing surface of the upper section;

an upstanding support post having an upper end to which the upper section is connected and a lower end to which the lower section is connected, a first mounting member interposed between the lower end of the support post and the lower section, the first mounting member including a cup-shaped section for accepting the lower end of the support post for attachment of the first mounting member thereto and including a protuberance joined to the cup-shaped section thereof so as to extend therefrom, the first mounting member being sized for acceptance of its cup-shaped section by the upwardly-opening recess and for acceptance of its protuberance by the through-opening associated with the upwardly-opening recess when the cup-shaped section is accepted by the upwardly-opening recess, the protuberance of the first mounting member having a free end within which a fastener-accepting aperture is defined;

a first fastener having an elongated shank and ahead at one end of its shank, the shank of the first fastener directed upwardly through the downwardly-facing surface of the lower section and into the fastener-accepting aperture of the protuberance of the first mounting member so that the lower section is tightly held between the cup-shaped section of the first mounting member and the head of the first fastener;

a second mounting member interposed between the upper end of the support post and the upper section, the second mounting member including a cup-shaped section for accepting the upper end of the support post for attachment of the second mounting member thereto and including a protuberance joined to the cup-shaped section thereof so as to extend therefrom, the second mounting member being sized for acceptance of its cup-shaped section by the downwardly-opening recess and for acceptance of its protuberance by the through-opening associated with the downwardly-opening recess when the cup-shaped section is accepted by the downwardly-opening recess, the protuberance of the second mounting member having a free end within which a fastener-accepting aperture is defined; and a second fastener having an elongated shank and a head at one end of its shank, the shank of the second fastener directed downwardly through the upwardly-facing surface of the upper section and into the fastener-accepting aperture of the protuberance of the second mounting member so that the upper section is tightly held between the cup-shaped section of the second mounting member and the head of the second fastener.

14. The table as defined in claim 13 wherein the upper section includes a tabletop layer overlying the upwardly-facing surface of the upper section and which hides the head of the one fastener from view.

15. The table as defined in claim 13 wherein the support post is constructed of glass and the first and second mounting means are secured to the corresponding ends of the support post with adhesive.

* * * * *